US006669704B2

(12) United States Patent
Inoue et al.

(10) Patent No.: US 6,669,704 B2
(45) Date of Patent: Dec. 30, 2003

(54) HAND-HELD EPILATING DEVICE

(75) Inventors: Tomoyuki Inoue, Hikone (JP); Hidekazu Sueyoshi, Kanzaki-gun (JP); Jyuzaemon Iwasaki, Nagahama (JP); Kotaro Yanagi, Hikone (JP)

(73) Assignee: Matsushita Electric Works, Ltd., Kadoma (JP)

( * ) Notice: Subject to any disclaimer, the term of this patent is extended or adjusted under 35 U.S.C. 154(b) by 142 days.

(21) Appl. No.: 09/978,098

(22) Filed: Oct. 17, 2001

(65) Prior Publication Data

US 2002/0052611 A1 May 2, 2002

(30) Foreign Application Priority Data

Oct. 26, 2000 (JP) ..... 2000-326976

(51) Int. Cl.[7] ..... A61B 17/50
(52) U.S. Cl. ..... 606/133
(58) Field of Search ..... 606/131, 133

(56) References Cited

U.S. PATENT DOCUMENTS 5,041,123 A 8/1991 Oliveau et al.
5,190,559 A 3/1993 Gabion et al.
5,207,689 A 5/1993 Demeester
5,356,415 A * 10/1994 Iwasaki et al. ..... 606/133
5,494,485 A * 2/1996 Gabion et al. ..... 606/133
5,857,903 A 1/1999 Ramspeck et al.
6,004,331 A * 12/1999 Takeuchi et al. ..... 606/133
6,045,559 A 4/2000 Sueyoshi et al.
6,287,190 B1 * 9/2001 Inoue et al. ..... 452/82
6,322,569 B1 11/2001 Sueyoshi et al.
6,585,743 B2 * 7/2003 Dolev ..... 606/133

FOREIGN PATENT DOCUMENTS

EP 0 569 614 11/1993

* cited by examiner

*Primary Examiner*—Kevin Shaver
*Assistant Examiner*—Michael B. Priddy
(74) *Attorney, Agent, or Firm*—Oblon, Spivak, McClelland, Maier & Neustadt, P.C.

(57) ABSTRACT

An epilating device has a rotary cylinder carrying a plurality of pinching row units arranged around the cylinder. An actuator bar is connected to movable blades in each row unit and is caused by a driven mechanism to move the movable blades towards the adjacent blades for pinching body hairs therebetween and plucking the hairs as the cylinder rotates. After the actuator bar is released from the driven mechanism, the bar is urged by a return spring to move the blades away from the adjacent blade to be ready for subsequent hair pinching. All the actuator bars spaced circumferentially around the cylinder and provided respectively for the row units are coupled commonly to the one return spring so that the epilating device can have an increased number of the row units around the cylinder only at a minimum number of the springs.

21 Claims, 15 Drawing Sheets

HAND-HELD EPILATING DEVICE

BACKGROUND ART

1. Field of the Invention

The present invention is directed to a hand-held epilating device, and more particularly to such a device having a rotary cylinder carrying a plurality of hair pinching rows arranged around an axis of the rotary cylinder.

2. Description of the Prior Art

U.S. Pat. No. 5,190,559 discloses a prior art epilating device which has a rotary cylinder carrying a pair of hair pinching rows spaced circumferentially around the rotary cylinder. Each of the pinching rows includes a plurality of stationary blades and a plurality of movable blades which are arranged along the lengthwise direction of the rotary cylinder with the tow adjacent movable blades disposed on opposites of each stationary blade. The movable blades in each pinching row are supported to a pair of actuator bars which are driven to counter-reciprocate along the longitudinal axis of the rotary cylinder in order to shift the movable blades towards the adjacent stationary blades for pinching the body hairs between the blades. Subsequently, the pinched hairs are plucked from a user's skin as the rotary cylinder rotates. In order to catch the hairs between the blades as well as to release the plucked hairs, the actuator bars in each pinching row is urged by a return spring to move the movable blades away from the adjacent stationary bars prior to and subsequent to pinching the hairs. The spring is required between the counter-reciprocating actuator bars in each pinching row. That is, each pinching row necessitates one return spring. Consequently, as the number of the pinching rows increases, a correspondingly increased number of the springs have to be incorporated in the rotary cylinder, which incurs difficulty of assembling the increased number of the springs into the rotary cylinder. Therefore, it has not been practical to provide a large number of the pinching rows yet using the return springs for each of the pinching rows.

SUMMARY OF THE INVENTION

The present invention has been accomplished in view of the above insufficiency to provide an improved epilating device which is capable of realizing an increased number of the pinching rows around a rotary cylinder with a minimum number of return springs. The epilating device in accordance with the present invention includes a housing to be grasped by a hand of a user, and a rotary cylinder mounted to the housing and having a longitudinal axis. The rotary cylinder carries a plurality of pinching row units which are circumferentially spaced about the longitudinal axis. Each pinching row units includes at least one set of blades arranged along the longitudinal axis of the cylinder. Also included in the rotary cylinder are a plurality of actuator bars which are arranged circumferentially about the longitudinal axis and are associated with the pinching rows, respectively. Each of the actuator bars extends through the rotary cylinder and is driven to shift along the longitudinal axis. Each actuator is connected to move at least one of the blades in each pinching row unit against and away from the adjacent stationary blade for catching and pinching the body hairs therebetween. A drive mechanism is provided for driving the actuator bars to reciprocate along longitudinal axis while rotating the rotary cylinder about the longitudinal axis for pinching the body hairs between the adjacent blades and plucking the hairs from the user's skin. The distinguishing feature of the present invention resides in that all the circumferentially spaced actuator bars are coupled commonly to a single return spring so as to be urged thereby in a direction of moving the blades away from the adjacent blade. Accordingly, an increased number of the pinching rows can be realized around the rotary cylinder only with the use of a minimum number of the return spring.

It is therefore a primary object of the present invention to provide the epilating device which is capable of achieving efficient hair plucking due to the increased number of the pinching row units around the rotary cylinder, yet ensuring to moving the movable blades away from the adjacent stationary blades by the use of the return spring for successfully catching the hairs with increased hair trapping efficiency.

In a preferred embodiment, the return spring includes a plurality of spring arms extending radially from a center hub secured to the rotary cylinder. Each spring arm is held in pressing engagement simultaneously with the circumferentially adjacent actuator bars for urging the bars axially outwardly of the rotary cylinder. Thus, the number of the spring arms can be half that of the circumferentially arranged pinching units, thereby simplifying the structure of the return spring.

The spring arm is U-shaped to have a first radial segment extending from the hub and a second radial segment which extends from the outer radial end of said first radial segment through an arc segment and projects radially inwardly from the arc segment. The second radial segment is utilized to be held in pressing engagement commonly with the two circumferentially adjacent actuator bars. With this U-shaped configuration, the second radial segment can be given an effective spring length which is sufficiently long relative to a radial dimension of the return spring, thereby giving a sufficient biasing force for moving the blade away from the adjacent blade only at a minimum radial dimension of the return spring.

In order to further increase the spring force, the spring arms are shaped to extend in a spiral fashion from the center hub about an axis of the hub. The hub may be formed with a hole which receives a portion of the rotary cylinder for fixedly mounting the return spring to the rotary shaft as well as for allowing an axle to pass therethrough for supporting the rotary cylinder to the housing.

Each of the actuator bars has a first end coupled to at least one blade in each set of blades and has a second end projecting on one longitudinal end face of the rotary cylinder in an opposing relation to a cam roller which is included in the drive mechanism. The cam roller is positioned to be in selective contact with the second ends of the actuator bars in such a manner as to move the actuator bars in a direction of pinching the body hairs between the blades as the rotary cylinder rotates about the longitudinal axis. The second end of each actuator bar is shaped to extend circumferentially about the longitudinal axis give an arcuate flange. The arcuate flanges of the circumferentially adjacent actuator bars are partially overlapped with each other in a radial direction of the rotary cylinder such that the overlapped portions of the arcuate flanges come simultaneously into contact with the cam roller. In this connection, each spring arm of the return spring is engaged with the radially overlapped portions of the arcuate flanges of the two circumferentially adjacent actuator bars. With this arrangement, the arcuate flanges of the adjacent actuator bars come into simultaneous contact with the cam roller to keep pinching the hairs over a prolonged period during which the cylinder continues rotating to pluck the hair successfully. Therefore, it is possible to arrange an increased number of the pinching rows around the rotary cylinder of a limited diameter, yet assuring to make the hair plucking successfully.

It is preferred that each of said arcuate flanges is formed at its opposite ends with receding slant faces away from the cam roller in order to reduce an impact when the actuator bars come into contact with the cam roller, thereby assuring smooth closing and opening movement of the blades and therefore reduced-in-noise operation.

In a preferred embodiment, each pinching row units includes a plurality of stationary blades and a corresponding number of movable blades which are arranged alternately in a direction parallel to said longitudinal axis. An advantageous feature associated with this embodiment resides in that the two longitudinally adjacent stationary blades in each of said pinching row units are integrally shaped from the same metal into a single integrated piece in which the two adjacent stationary blades are inseparably continuous with each other, and that the integrated piece is associated with the two adjacent movable blades which are connected commonly to one of the actuator bars and are caused thereby to move simultaneously against and away from the stationary blades of the integrated piece. With the use of the integrated piece, the two metal-made stationary blades can be positioned accurately or have precise dimensional relationship with each other, thereby been given uniform pinching effects with the associated movable blades driven to move simultaneously by a single actuator bar. Thus, it is easy to eliminate undesired variation in the hair pinching effects between the stationary blades and therefore to assure consistent and effective hair plucking.

Preferably, the two movable blades associated with the integrated piece are pivotally supported to a holder plate so as to be pivotable about a pivot axis perpendicular to the longitudinal axis of the rotary cylinder for movement against and away from the associated stationary blades. The holder plate mounts at least one integrated piece and the associated movable blades and consolidating these members together into a self-sustained sub-assembly which is fitted on the surface of said rotary cylinder. Thus, the pinching row units can be easily assembled to the rotary cylinder for increasing manufacturing efficiency.

The holder plates also mounts a skin guide which is disposed between the two adjacent stationary blades of the integrated piece and has an arcuate surface for smooth contact with the skin of the user's body. The skin guide is consolidated into the sub-assembly and has a grip which fixes the integrated piece to the holder plate in a correct position relative to the corresponding movable blades. The skin guide can be molded from a plastic material so as to be easy to be press-fitted to the holder plate, and is therefore best utilized to unite the metal-made integrated piece, i.e., the stationary blades to the holder.

The two adjacent stationary blades are interconnected by a pair of beams extending in the direction of the longitudinal axis and merging at opposite lengthwise ends into lower ends of the stationary blades. Formed at the connection between the beams and the stationary blades are resilient segments which are responsible for absorbing a stress applied to the stationary blade from the associated movable blade. Thus, excessive force applied to one of the stationary blade from the movable blade can be well absorbed at the resilient segments, which making it easy to balance the pinching forces at the two stationary blades for uniform plucking of the hairs.

The arcuate surface of the skin guide is formed at its one end with a rounded edge which is continuous with a remainder of the arcuate surface and has a curvature greater than that of the remainder of the arcuate surface. The rounded edge of increased curvature can well prevent the skin from being irritated when the skin guide comes firstly into contact with the skin as a consequence of the rotary cylinder rotates, thereby assuring comfortable hair plucking.

Each of the stationary blade and the corresponding movable blade may be formed at its one lengthwise facing toward a rotating direction of said rotary cylinder with a flared edge. The flared edges are cooperative with each other to define therebetween a tapered groove for smoothly guiding the hairs into between the blades.

In the preferred embodiment, the two integrated pieces are mounted to the one holder plate to constitute the sub-assembly in which the four stationary blades are evenly spaced along the longitudinal axis of the rotary cylinder. The rotary cylinder carries a plurality of the sub-assemblies which are circumferentially spaced about the longitudinal axis with the sub-assemblies being staggered with each other with respect to the longitudinal axis, in order to increase chances of the hair plucking within the length of the rotary cylinder. For maximum efficiency of plucking the hairs per length of the rotary cylinder, all the stationary blades of different rows are offset from each other with respect to the longitudinal axis of the cylinder.

These and still other objects and advantageous features of the present invention will become more apparent from the following description of the preferred embodiment when taken in conjunction with the attached drawings.

MODE FOR CARRYING OUT THE INVENTION

Figure 1:
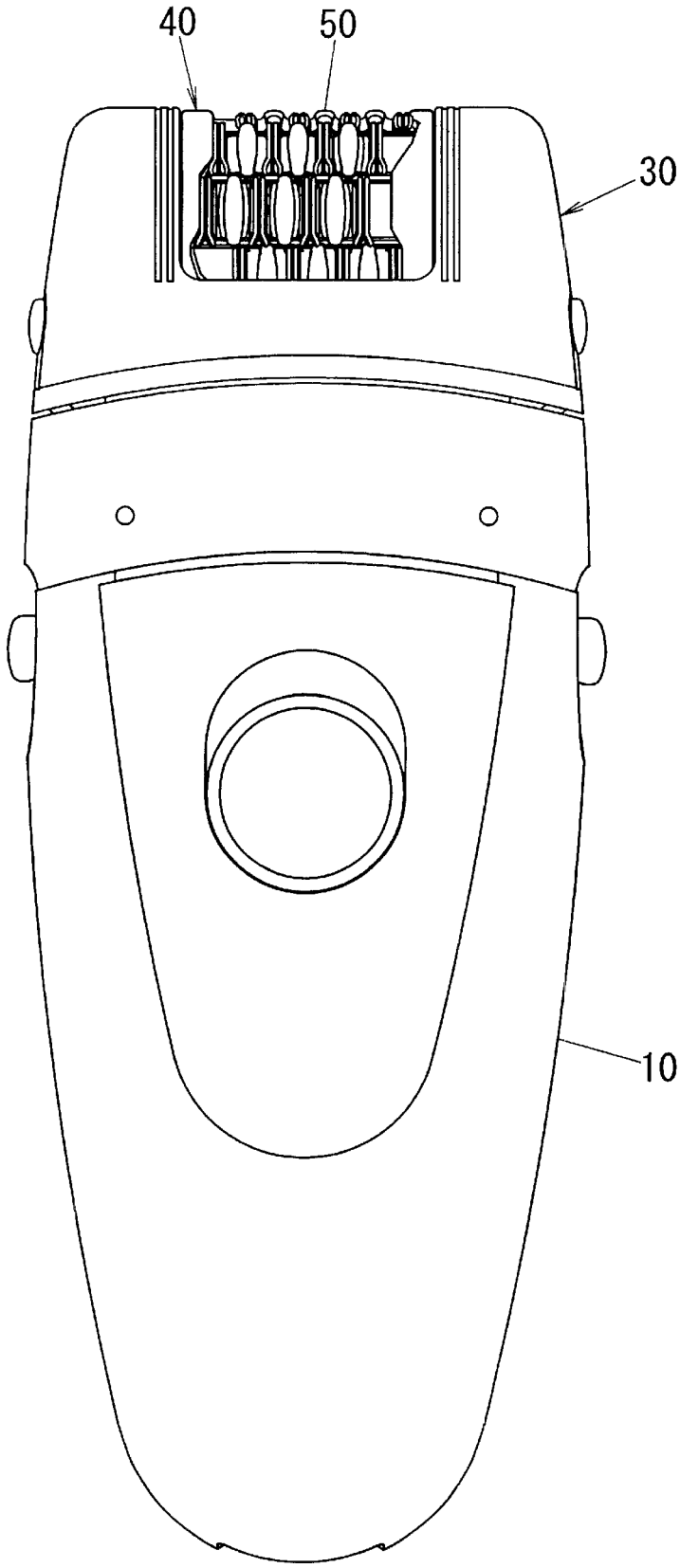
FIG. 1 is a front view of a hand-held epilating device in accordance with a preferred embodiment of the present invention.

Referring now to FIG. 1, there is shown a hand-held epilating device in accordance with a preferred embodiment of the present invention. The epilating device has a housing 10 to be grasped by a user's hand and an epilator head 30 detachably mounted on top of the housing 10. The epilator head 30 carries a rotary cylinder 40 which is driven to rotate about its longitudinal axis for plucking body hairs from the skin of a user. The housing 10 accommodates an electric motor and a set of driving gears for providing a driving source of rotating the rotary cylinder 40 and simultaneously vibrating the cylinder along the longitudinal axis for maximizing for maximizing the chance of plucking the hairs on the surface of the rotary cylinder 40.

Figure 2:
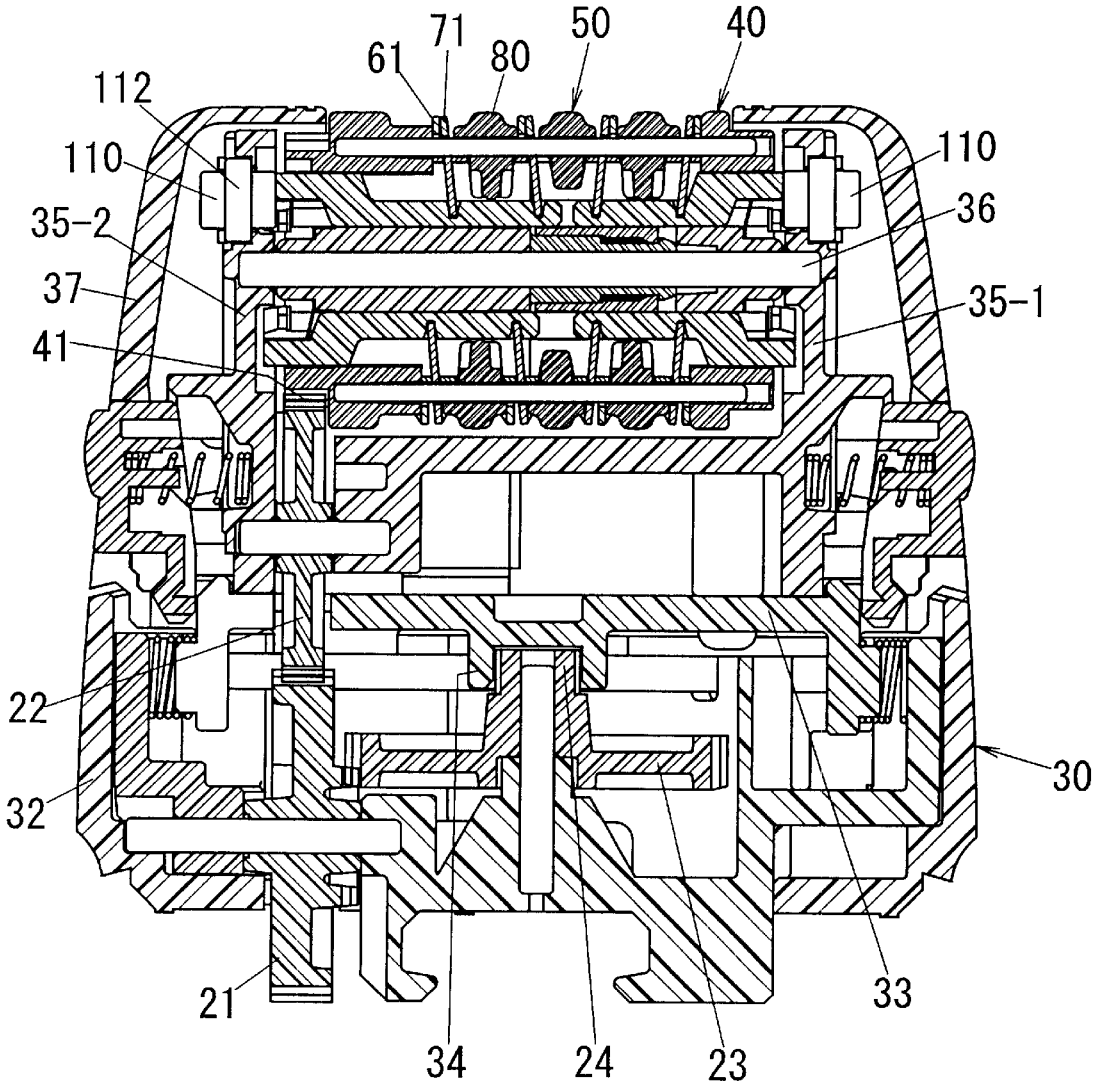
FIG. 2 is a vertical section of a major portion of the epilating device.
Figure 3:
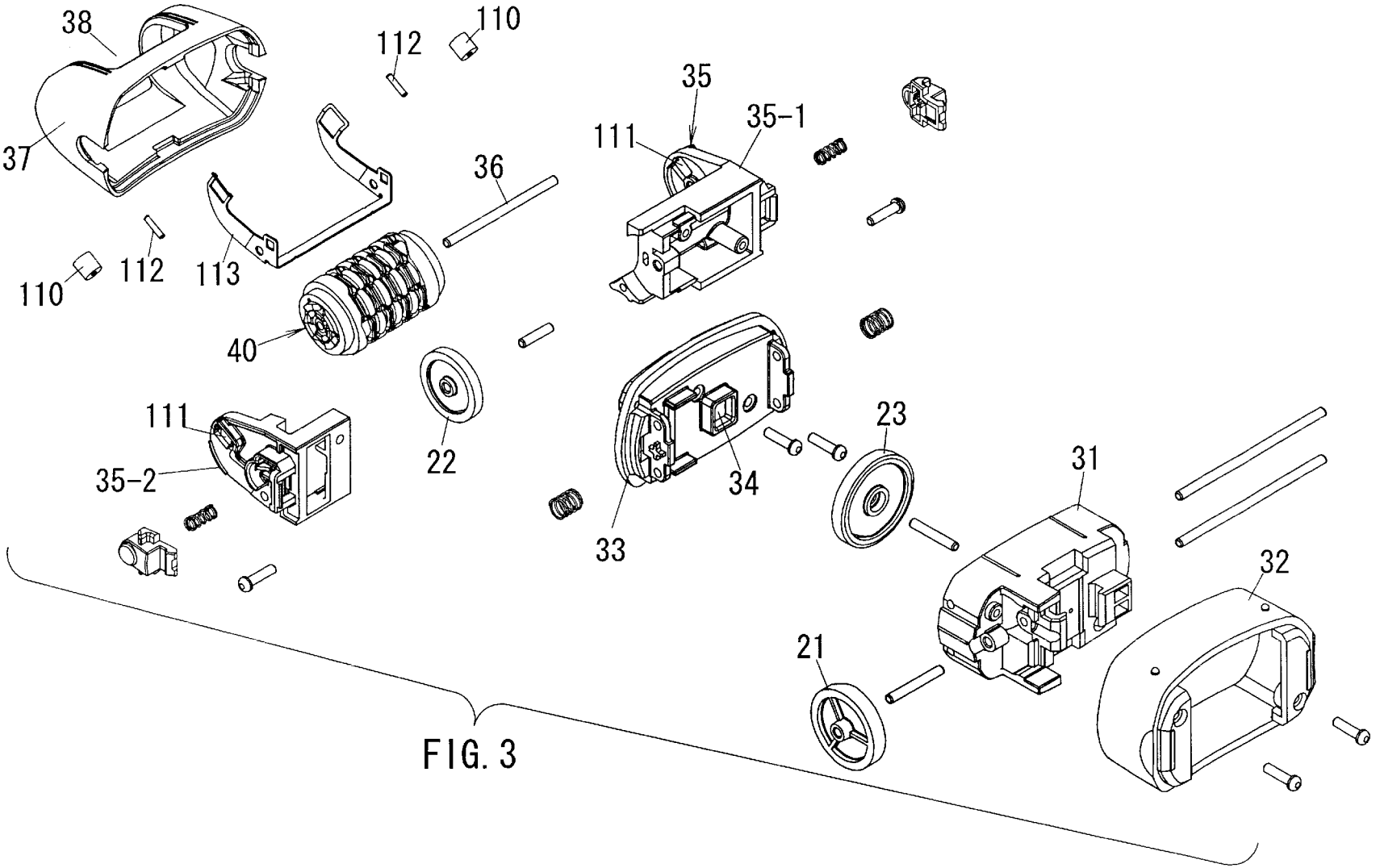
FIG. 3 is an exploded perspective view of an epilator head of the epilating device.

As shown in FIGS. 2 and 3, the epilator head 30 is composed of a base 31 detachably mounted to the housing 10, a base cover 32, a reciprocating platform 33, a head frame 35 supporting a rotary cylinder 40, and a head cover 38. The base 31 carries a first driven gear 21 which comes into meshing engagement with a driving gear (not shown) exposed on top of the housing 10 when the head 30 is attached to the housing. The head frame 35 has an axle 36 which extends between a main-frame 35-1 and a sub-frame 35-2 which are assembled together with a second driven gear 22 interposed therebetween. The second driven gear 22 meshes with the first driven gear and with a gear 41 formed at one longitudinal end of the rotary cylinder 40 to rotate the cylinder about its longitudinal axis defined by the axle 36. The head frame 35 is supported to the reciprocating platform 33 which is driven to reciprocate along the axle relative to the base 31 while the rotary cylinder 40 is rotated. For reciprocating the cylinder 40, the base 31 carries a gear 23 which meshes with one side of the first driven gear 21 to be driven thereby to rotate about an upright axis and has an eccentric cam 24. The cam 24 engages into a rectangular slot 34 in the bottom of the platform 33 for translating the rotary movement of the gear 23 into the reciprocating movement of the platform 33. The head cover 37 is secured to the platform 33 and has an opening 38 through which substantially the full length of the rotary cylinder 40 is exposed for contact with the skin of the user.

The rotary cylinder 40, which is molded from a plastic material, carries a plurality of hair pinching row units 50 which are evenly spaced around the circumference of the cylinder. As best shown in FIGS. 4 to 7, each row unit 50 includes four stationary blades 61 which are aligned along the axis of the cylinder, four movable blades 71 which alternate the stationary blades, and three skin guides 80 interposed between the adjacent stationary blades 61. These members are commonly supported to a single metal-made holder plate 90 to define a self-sustained sub-assembly which is easily fitted around the cylinder 40. The movable blades 71 are caused to pivot about an axis perpendicular to the longitudinal axis of the rotary cylinder 40 to open and close the gap between the adjacent blades 61 and 71 as the rotary cylinder 40 rotates about the longitudinal axis, thereby catching and pinching the hairs between the blades. The closure of the blades 61 and 71 are kept over a certain angular displacement around the longitudinal axis, i.e., a fraction of one rotation of the rotary cylinder 40, thereby pulling the hairs pinched between the blades 61 and 71 in a tangential direction of the cylinder 40 for plucking the hairs.

Figure 6:
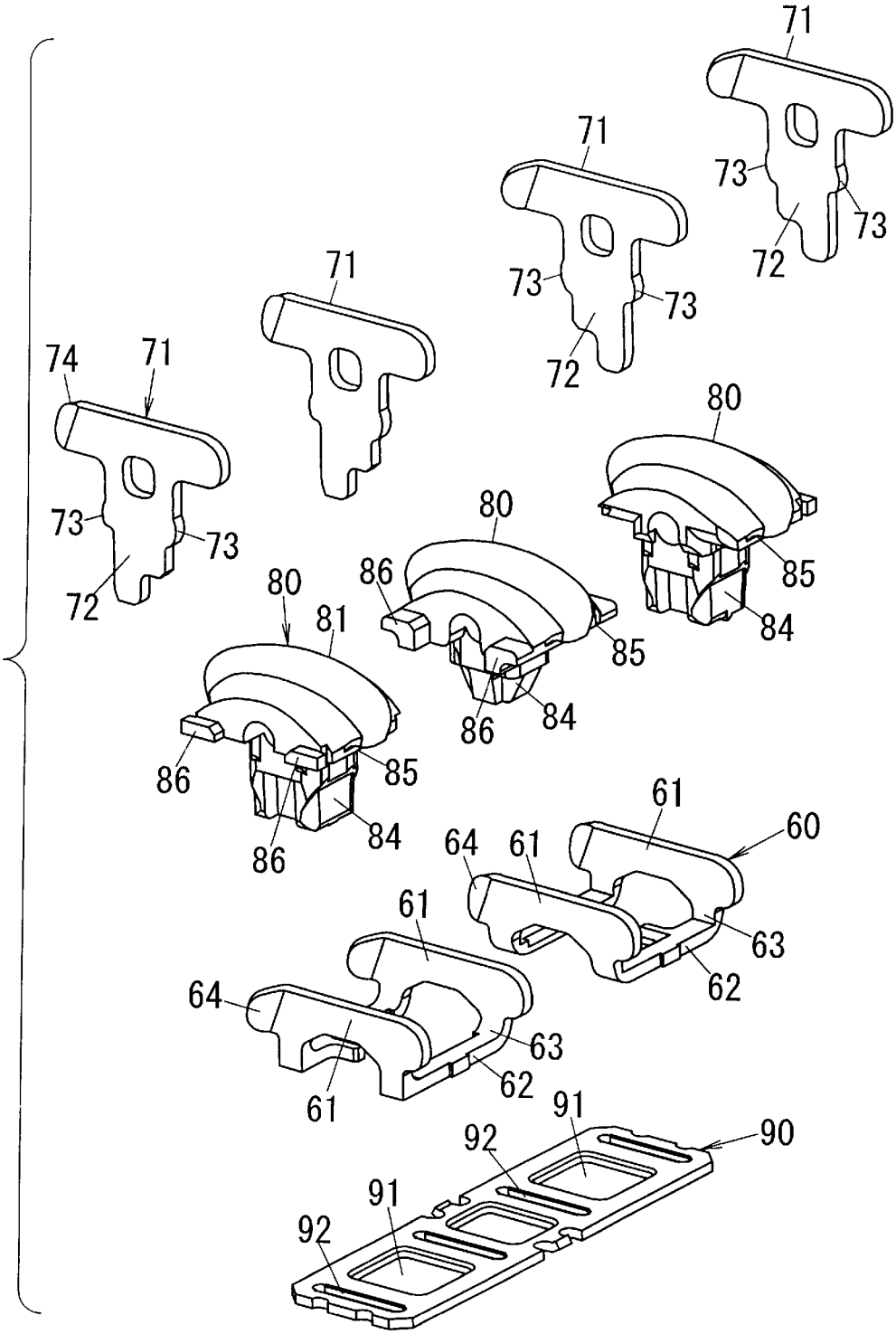
FIG. 6 is an exploded perspective view of a pinching row unit carried on the rotary cylinder.

As shown in FIG. 6, the two stationary blades 61 are shaped from a metal plate into an integrated piece 60 in which the blades 61 are inseparably continuous with one another through a pair of beams 62. The skin guide 80 is molded from a plastic material to have an arcuate surface 81 on its top for smooth contact with the skin of the user, and an anchor stud 84 which projects to be press-fitted into a corresponding hole 91 of the holder plate 90 by the use of resiliency inherently given to the molded part. Formed at the opposite side of the skin guide 80 are grips 85 which presses the beams 62 of the integrated piece 60 against the holder plate 90 so as to secure the stationary blades 61 to the holder plate at the same time as the skin guide 80 is secured to the plate. The movable blade 71 is made of a metal and has a leg 72 of which lower end is inserted into a corresponding slot 92 of the plate 90 so that the leg comes into edge-contact selectively with either one of the opposite edges of the slot 92. Formed on opposite of the leg are round projections 73 which cam over inclines of hooks 86 on the skin guide 80 and are retained loosely behind the hooks 86. Whereby, the movable blades 71 can be pivotally supported to the holder plate 90 and complete the self-sustained sub-assembly which can be handled as one block when assembling the pinching row units into the rotary cylinder 40. Two integrated pieces 60, i.e., four stationary blades 61, four movable blades 71, and three skin guides 80 are supported to one holder plate 10 to constitute each one of the plural pinching row units 50. After the row units 50 are placed in corresponding grooves 42 of the rotary cylinder 40, a corresponding number of pins 51 are inserted into the cylinder with each pin extending through the stationary blades 61, the movable blades 71, and the skin guides 80 to hold the row units in position where, as best shown in FIG. 4, the movable blades 71 are linked to actuator bars 101 and 102 which are inserted in the rotary cylinder 40 for imparting the pivotal movement to the movable blades 71 for closing and opening the gap between the blades 61 and 71.

Figure 4:
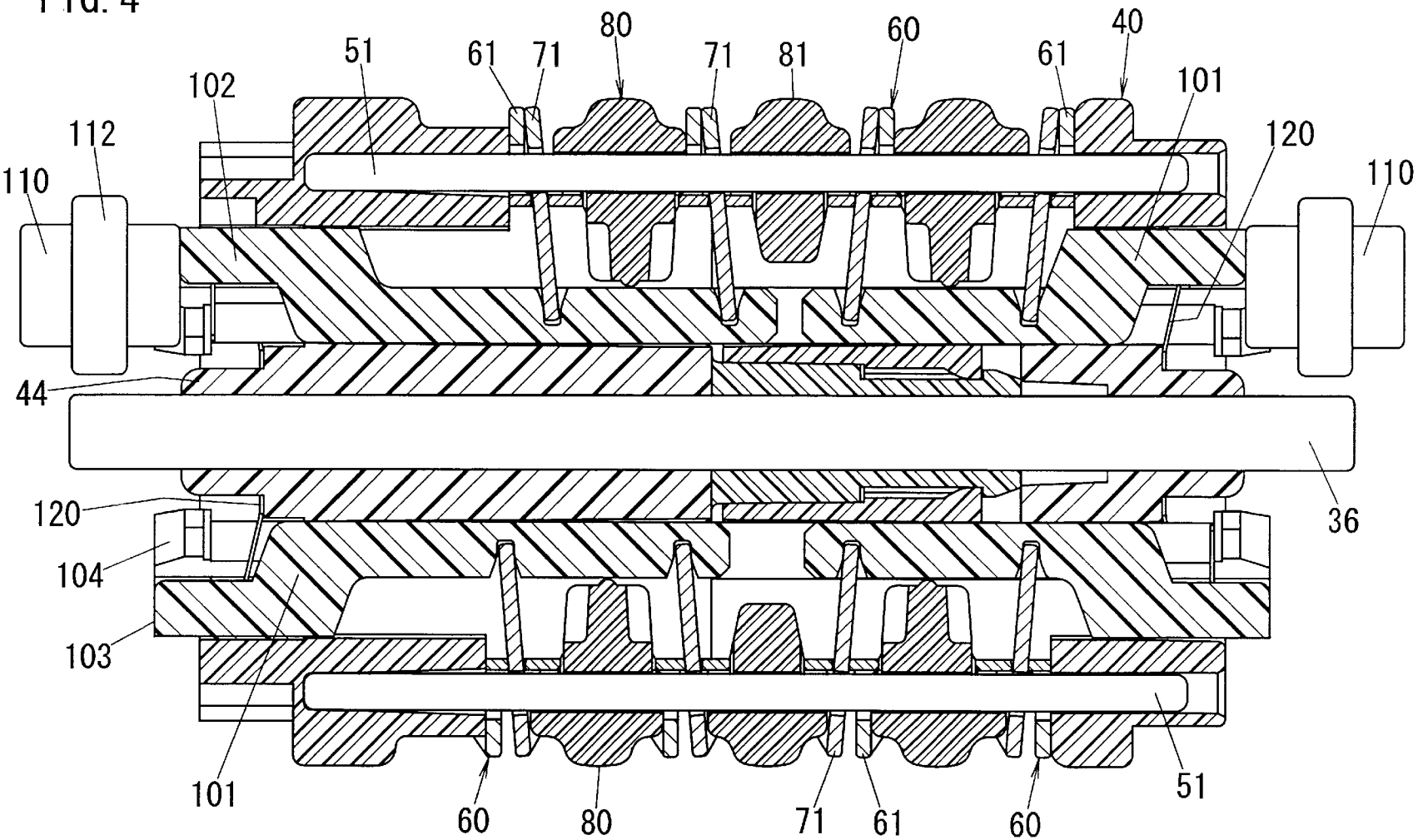
FIG. 4 is a vertical section of a rotary cylinder constituting the epilator head.

The actuator bars 101 and 102 are provided in number double the number of the row units 50, i.e., eight bars in each longitudinal half of the cylinder 40 so that each bar is linked to actuate the two adjacent movable blades 71 in each one of the row units 50, as shown in FIGS. 2 and 4. That is, each actuator bar is linked to actuate the two movable blades 71 simultaneously to open and close in association with the two stationary blades 61 of each integrated piece 60. Thus, the two movable blades 71 pivot simultaneously in the same direction for making closing and opening movements relative to the two stationary blades 61 common to the single integrated piece 60, i.e., two stationary blades having dimensional stability with respect to one another, thereby facilitating to achieve uniform hair pinching effects at the stationary blades, in addition to achieving a strong pinching effect by the use of metal-made blades 61 and 71. In addition, the beams 62 merge into legs 63 of reduced width which is formed at the lower end of each stationary blade 61 to be resiliently deformable to some extent for absorbing an excessive stress applied from the counterpart movable blade 71. With this capability of absorbing the excessive stress, it is possible to balance the pinching forced developed at the two stationary blades 61 of the integrated piece 60, even if the movable blades 71 should be pressed differently. The actuator bars 101 and 102 are held in the bottom of the groove 42 of the row unit 50 to be axially slidable and are caused to move axially inwardly by the action of cam rollers 110 as the cylinder 40 rotates and to move axially outwardly by the action of return springs 120 as the cylinder 40 further rotates, thereby repeating to close and open the blades during one rotation of the cylinder.

Figure 5:
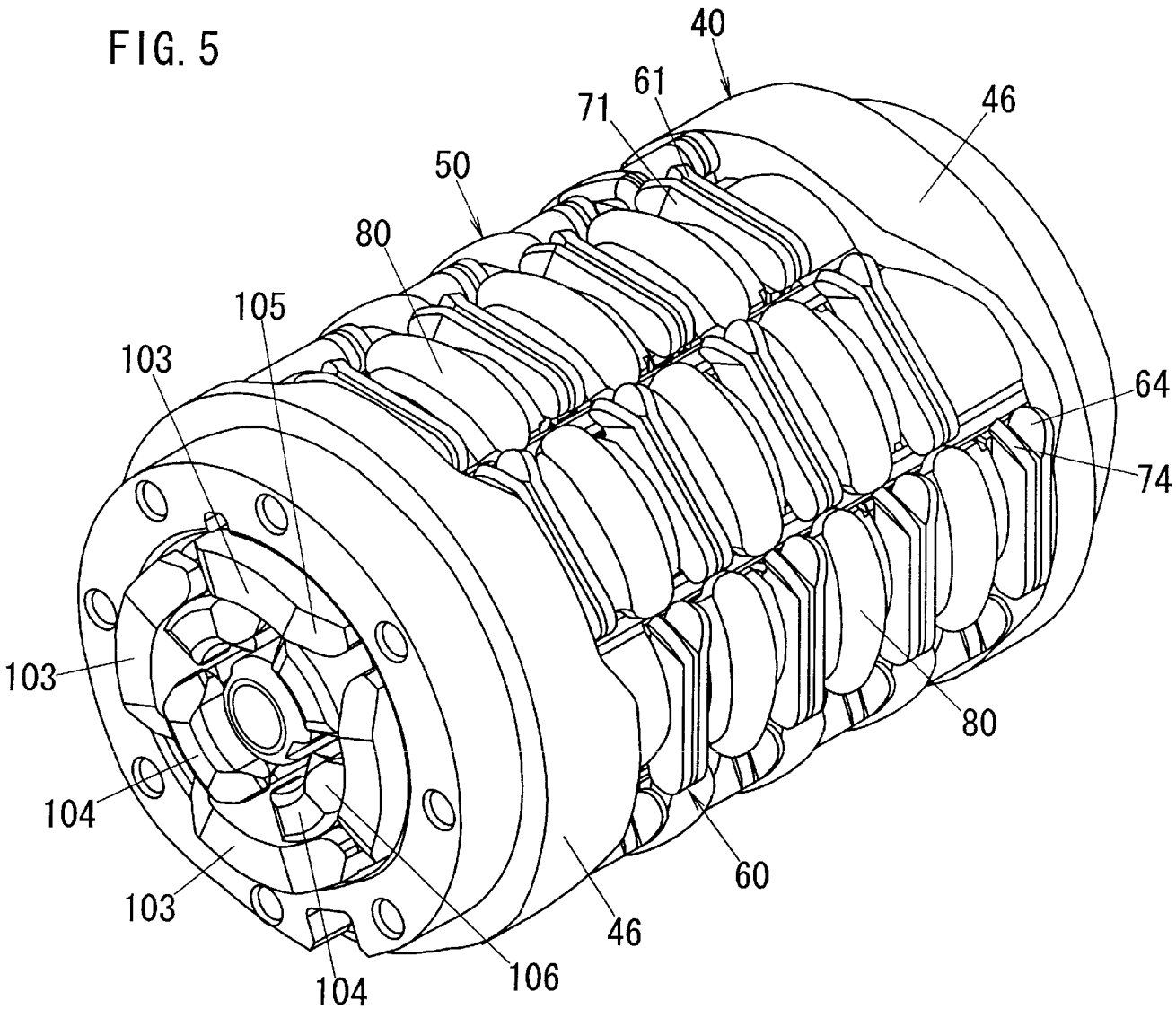
FIG. 5 is a perspective view of the rotary cylinder.
Figure 7:
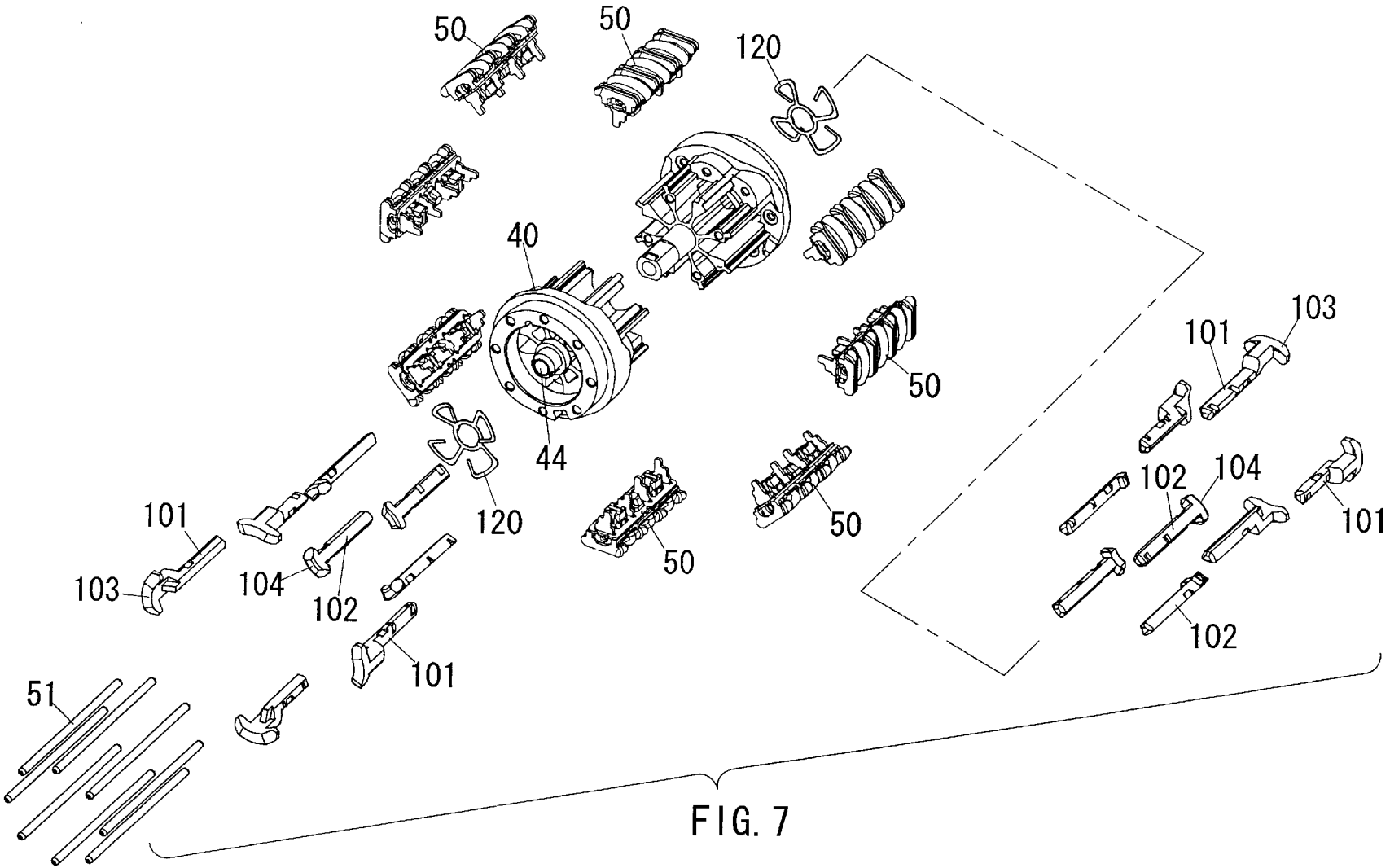
FIG. 7 is an exploded perspective view of the rotary cylinder.

The actuator bars 101 and 102 are each formed at its axially outer end with an arcuate flange 103, 104 which extends circumferentially about the longitudinal axis of the cylinder 40 for pressed contact with the corresponding cam roller 110 over a prolonged period as the cylinder 40 rotates. As best shown in FIGS. 5 and 7, the actuator bars 101 and 102 consist of two types having different configurations, a first type having the arcuate flange 103 offset radially outwardly relative to a shank of the bar, and a second type having the arcuate flange 104 generally aligned with the shank of the bar. The first and second types of the actuator bars 101 and 102 are arranged in such a manner that, as shown in FIG. 5, the arcuate flanges 103 of the first type are closely arranged along an outer circumferential row about the longitudinal axis of the cylinder 40, while the arcuate flanges 104 of the second type are closely arranged along an inner circumferential row about the longitudinal axis. Further, the arcuate flanges 103 in the outer circumferential row are staggered circumferentially with respect to the arcuate flanges 104 of the inner circumferential row such that each arcuate flange 103 is radially overlapped with the two adjacent arcuate flanges 104 by a certain circumferential. It is noted that the cam roller 110 has an axial length so that it contacts simultaneously with the arcuate flanges 103 and 104 of the outer and inner circumferential rows, respectively. Thus, as the cylinder 40 rotates, the movable blades 71 in two or three adjacent row units 50 of the cylinder 40 are simultaneously closed, while the movable blades 71 in the other row units are opened. With this result, the movable blades 71 in each row are kept closed over a prolonged period as the cylinder rotates for successful hair plucking, while enabling to provide a large number of the row units around the circumference of the cylinder 40 of a limited diameter. As shown in FIGS. 2 and 3, the cam rollers 110 are mounted respectively in holes 111 of the head frame 35 and are rotatable about individual pins 112. Each cam roller is pressed inwardly against the actuator bar 101, 102 by spring props 113 secured to the head frame 35.

Figure 8:
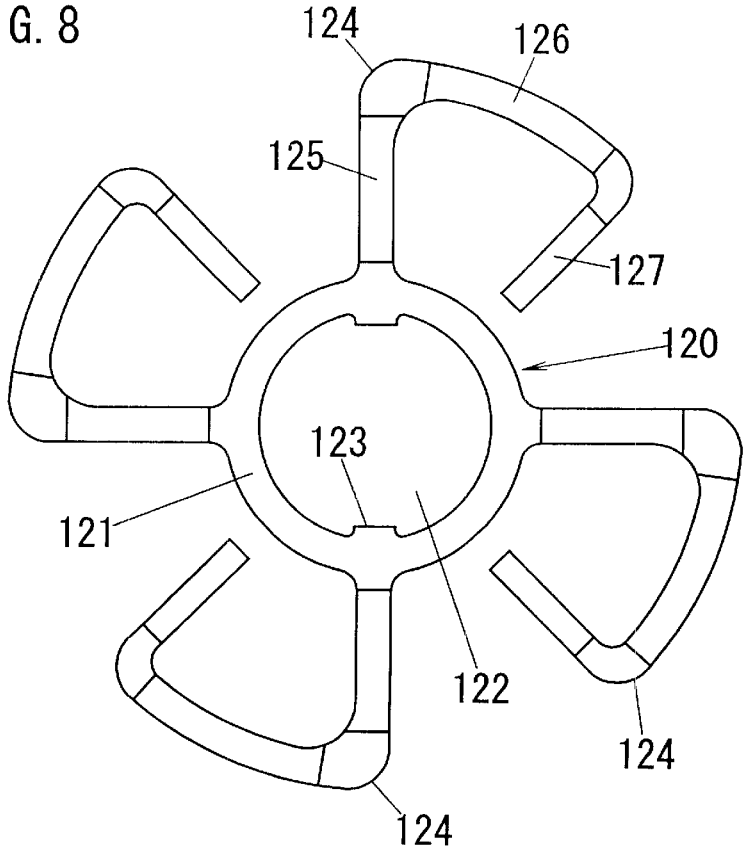
FIG. 8 is a front view of a return spring incorporated in the rotary cylinder.
Figure 9:
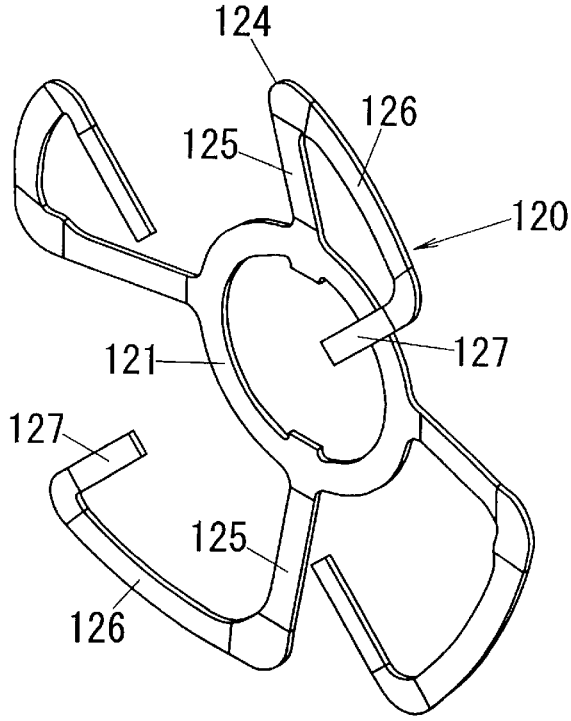
FIG. 9 is a perspective view of the return spring
Figure 10:
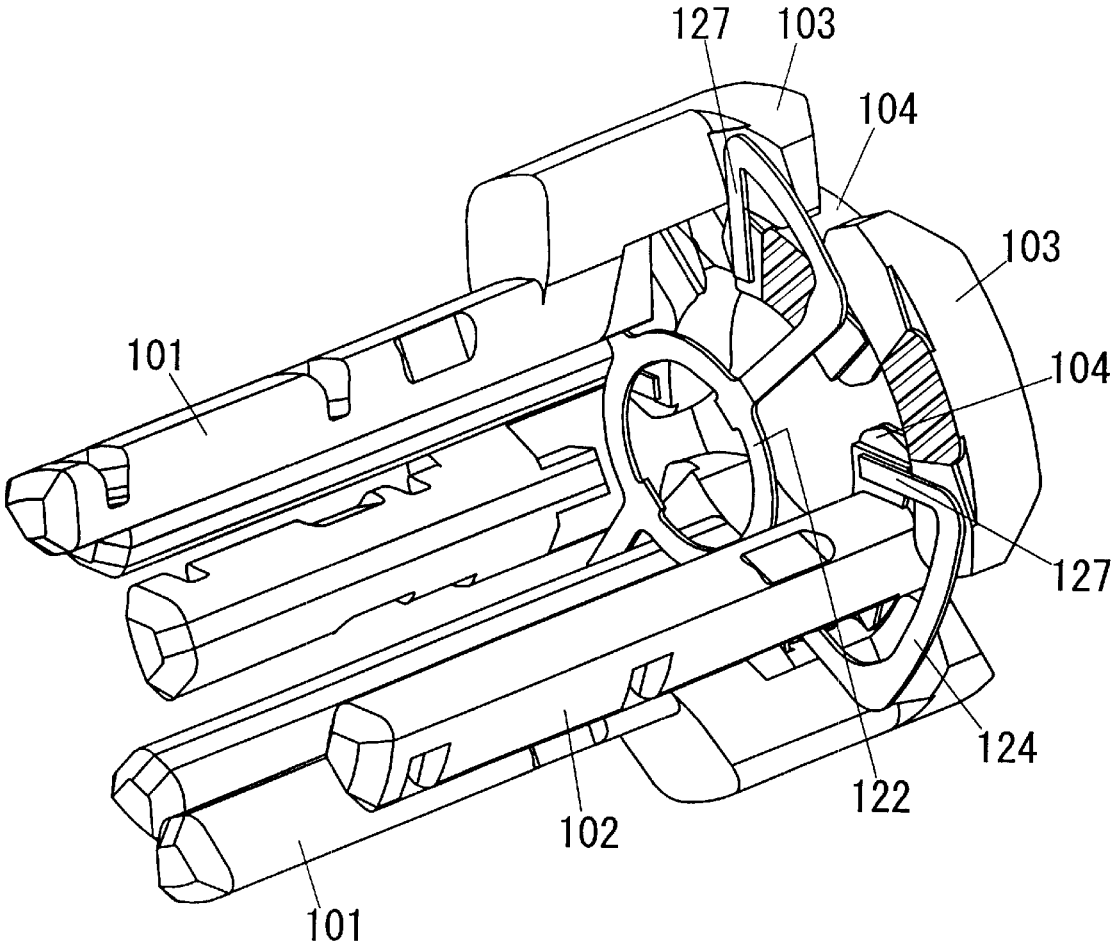
FIG. 10 is a perspective view of the return spring within the rotary cylinder shown with some parts removed for indicating the operative position of the return spring.

The return springs 120 are provided on opposite ends of the cylinder 40 for biasing the actuator bars 101 and 102 axially outwardly with one spring responsible for the eight actuator bars having the arcuate flanges 103 and 104 disposed on one end of the cylinder, and the other spring for the remaining eight actuator bars having the arcuate flanges 103 and 104 on the other end of the cylinder 40. That is, one return spring 120 is commonly used for urging the plural actuator bars in a direction of pivoting the movable blades 71 of the plural row units 50 away from the associated stationary blades 61. As shown in FIGS. 8 and 9, the return spring 120 is a one-piece member which is stamped from a resilient metal sheet into a star-shaped to have four spring arms 124 extending radially from a center hub 121 which is secured to the rotary cylinder 40. The center hub 121 has an opening 122 so as to be fitted around a center post 44 of the rotary cylinder 40 through which the axle 36 extends, and is fixedly secured thereto by engagement of bites 123 into the post. The spring arm 124 is of a generally U-shaped to have a first radial segment 125 extending outwardly from the center hub 121, an arc segment 126 extending from the outer end of the first radial segment 125, and a second radial segment 127 extending radially inwardly from the end of the arc segment 126. It is this second radial segment 127 that is pressed against the arcuate flanges 103 and 104 of the two circumferentially adjacent actuator bars 101 and 102, as best shown in FIG. 10, for biasing the movable blades 71 carried by the actuator bars away from the associated stationary blades 61. Thus, the spring arm 124 can have an effective spring length within a limited radius of the return spring so as to develop a sufficient spring force for successfully returning the movable blades to the open condition. Further, the spring arms 124 extend from the hub 121 in a spiral fashion about the center axis of the spring, i.e., the longitudinal axis of the cylinder 40, thereby further increasing the biasing force at a limited diameter of the return spring 120. In this connection, the return spring 120 is secured to the cylinder 40 with the individual spring arms 124 spirally extending axially outwardly of the cylinder for pressed contact with the corresponding arcuate flanges 103 and 104 of the actuators 101 and 102.

Returning back to FIG. 5, each of the arcuate flanges 103 and 104 is formed at its opposite ends with receding slant faces and 105 so that each arcuate flange comes into contact with the cam roller 110 by way of the slant face and out of contact therefrom also by way of the slant face, thereby reducing an impact at the time of closing and opening the blades and therefore assuring a reduced-in-noise hair plucking.

Figure 11:
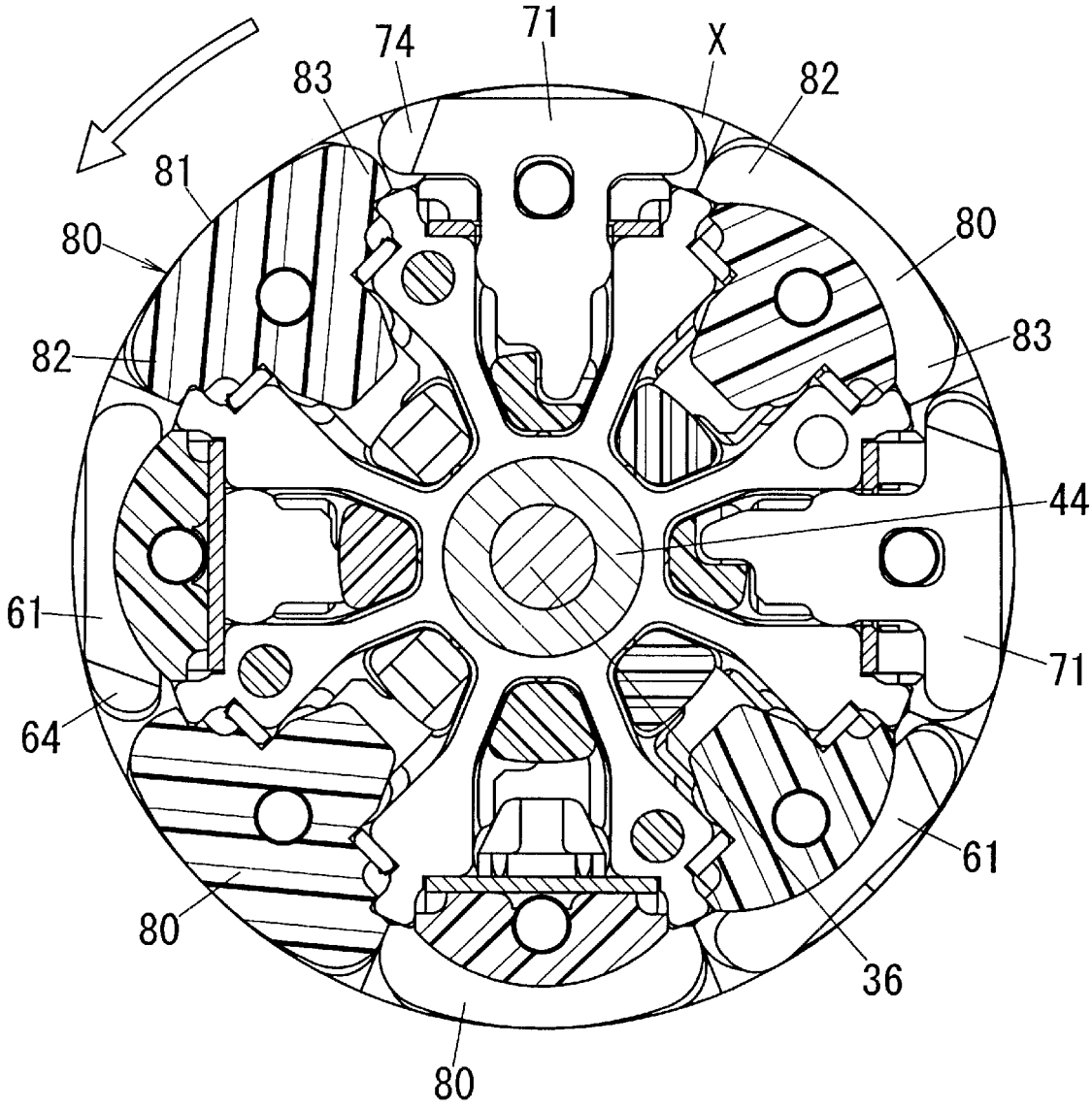
FIG. 11 is a sectional view of the rotary cylinder.

As shown in FIGS. 5 and 6, the stationary blade 61 and the associated movable blade 71 are formed at their one ends facing toward the rotating direction of the cylinder 40 with flared edges 64 and 74 which are cooperative to define therebetween a tapered groove for effectively guiding the hairs into between the blades. The rotary cylinder 40 is formed at its opposite axial ends with reduced-in-width sections 46 of uniform radius which defines an overall circular circumference of the rotary cylinder. As shown in FIG. 11, the stationary blades 61, the movable blades 71, and the skin guides 80 are arranged within the circumference X of the cylinder 40 in such a manner that each of the stationary blade 61 and movable blade 71 has its opposite circumferential end inscribed in the circumference, and that the arcuate surface 81 of the skin guide 80 has its middle portion inscribed in the circumference. The leading and the trailing edges of each of the stationary blades 61, movable blades 71, and the arcuate surfaces of the skin guides 80 are rounded in order to avoid irritating the skin. Particularly, the arcuate surface of the skin guide 80 has its leading and trailing edges 82 and 83 shaped to be smoothly continuous with the remainder of the arcuate surface and to have a curvature greater than that of the remainder arcuate surface.

Figure 12:
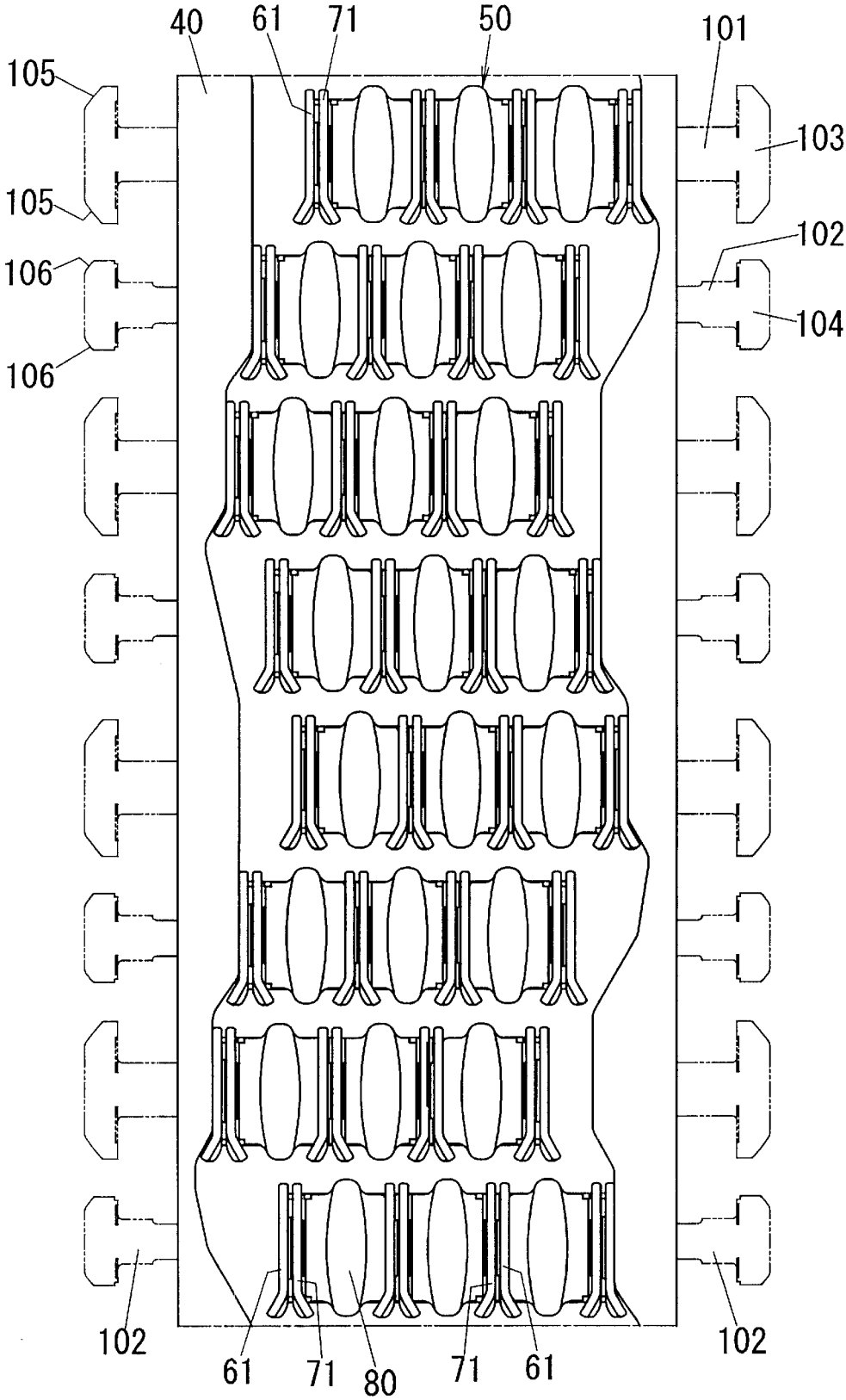
FIG. 12 is an expanded view of the rotary cylinder showing the arrangement of the pinching row units.

As shown in FIG. 12, the row units 50 are arranged on the cylinder 40 as being offset in the axial direction relative to each other so that the pairs of the stationary blade 61 and the movable blade 71 in anyone of the row units are staggered with the other pairs of the other row units with respect to the longitudinal axis of the cylinder, so that all the blade pairs are differently positioned with respect to the longitudinal axis of the cylinder for maximum plucking efficiency.

Figure 13:
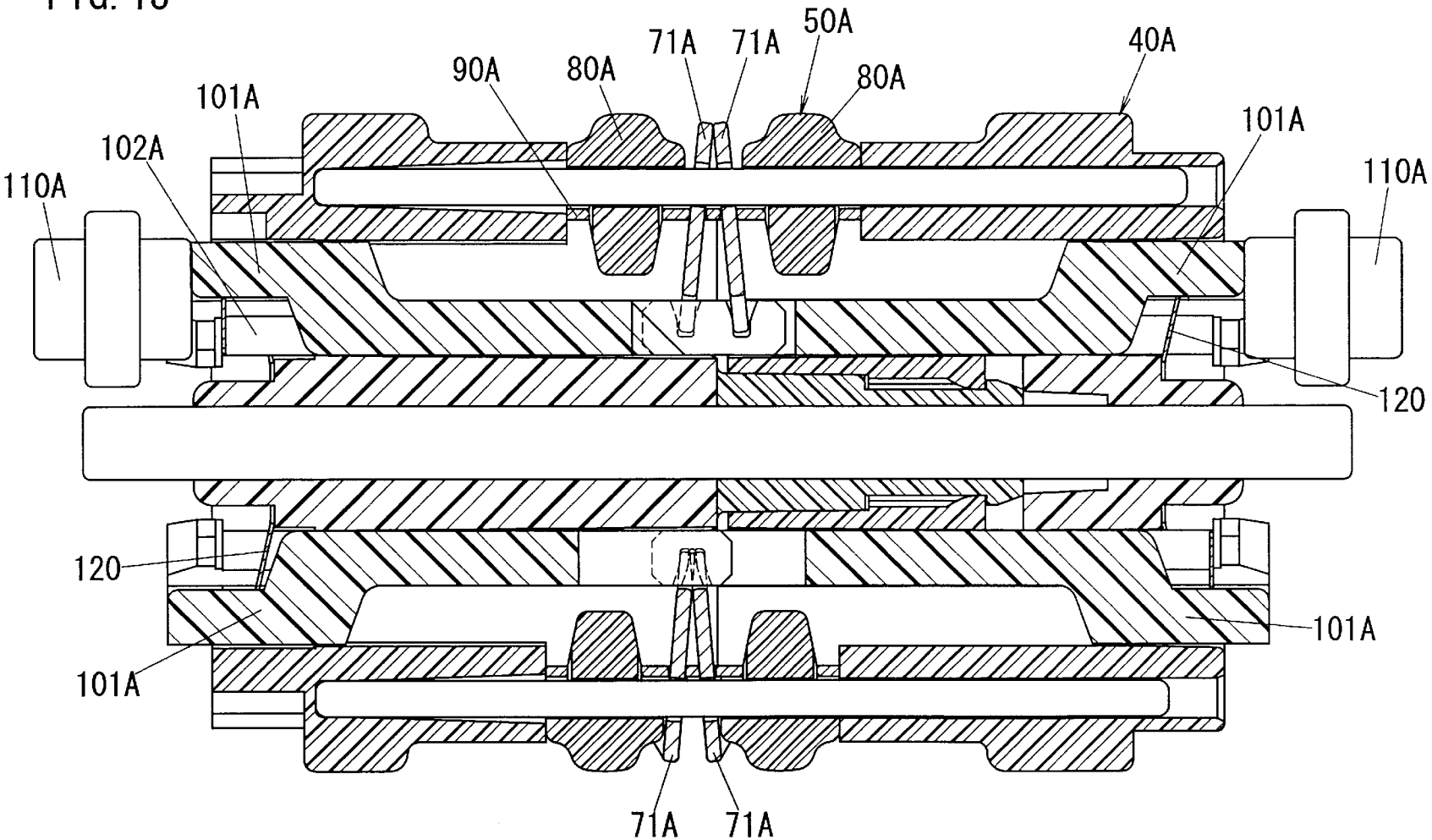
FIG. 13 is sectional view of a rotary cylinder for a hand-held epilating device in accordance with another embodiment of the present invention.
Figure 14:
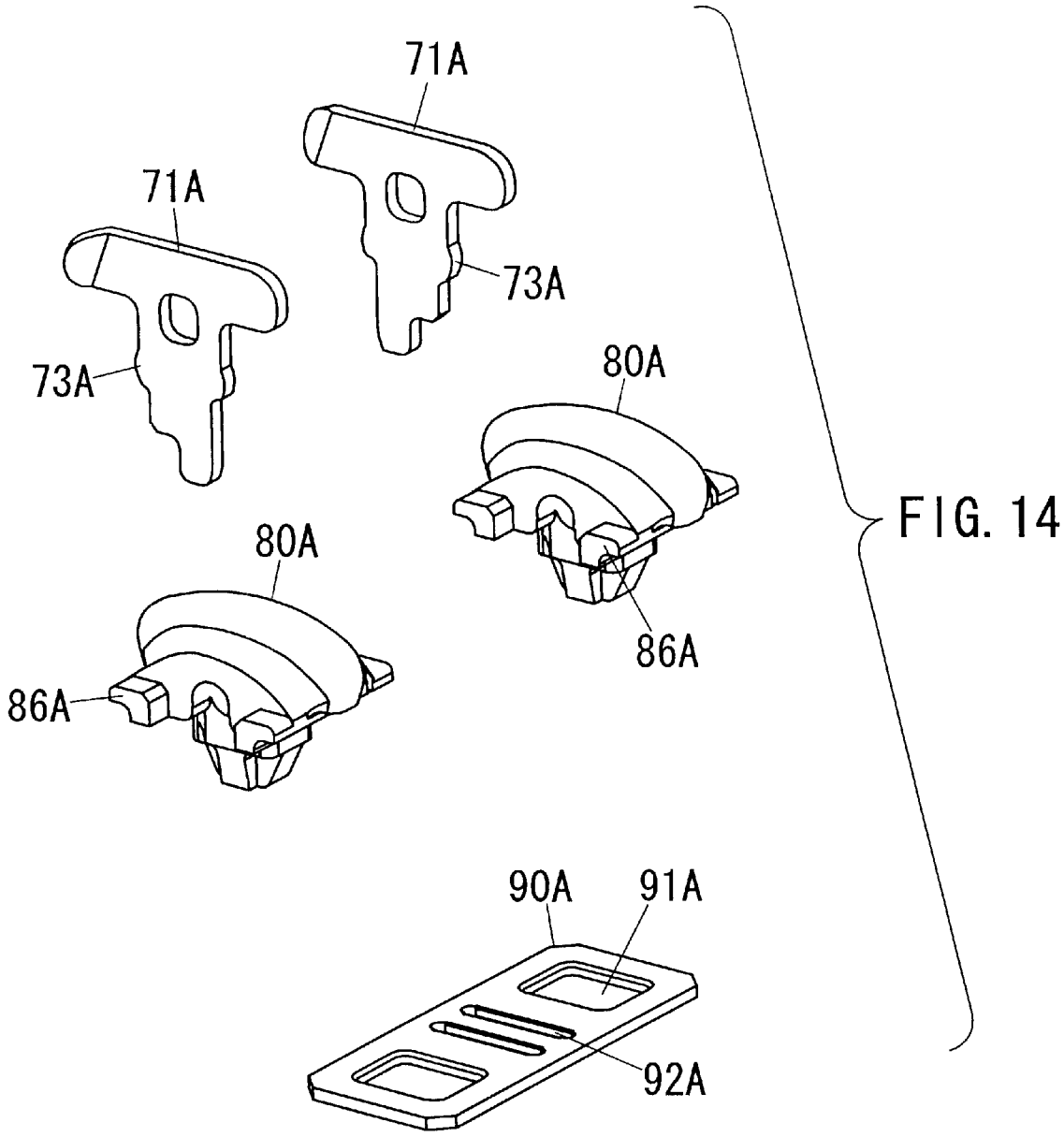
FIG. 14 is a perspective view of a portion of the rotary cylinder showing a return spring and associated parts.

FIG. 13 shows a rotary cylinder 40A employed in an epilating device in accordance with another preferred embodiment of the present invention which is identical to the above embodiment except for the configurations of the pinching row unit and the associated actuator bars 101A and 102A. Therefore, like parts are designated by like reference numerals with a suffix letter of 'A'. Each of the pinching row units 50A which are evenly spaced around the rotary cylinder 40A has only one set of movable blades 71A which are driven to move against and away from one another for catching the hairs therebetween. As shown in FIG. 14, the movable blades 71A are retained to a holder plate 90A together with skin guides 80A in the same manner as in the previous embodiment, and are capable of pivoting about an axis perpendicular to the longitudinal axis of the cylinder. That is, the skin guides are press-fitted to holes 91A of the holder plate 90A, and the movable blade 71A is loosely coupled to the adjacent skin guide 80A by engagement of round projections 73A with hooks 86A of the skin guide 80A. The movable blade 71A extends through a slot 92A of the plate and comes into edge contact with the edge of the slot to make the pivot movement when driven by corresponding actuator bars 101A and 102A.

Figure 15:
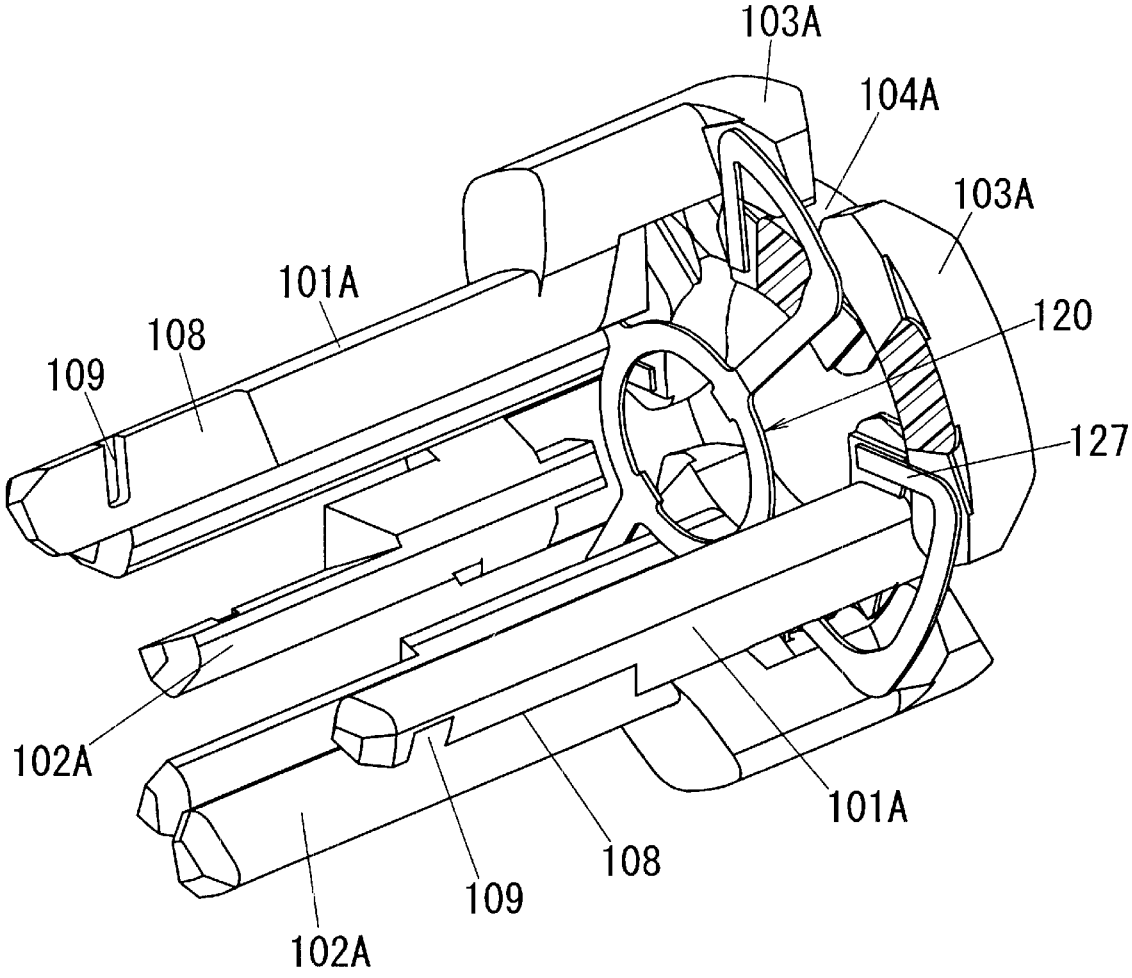
FIG. 15 is an exploded perspective view of a pinching row unit mounted on the rotary cylinder.

The rotary cylinder carries plural sets of actuator bars 101A and 102A which are arranged circumferentially about the longitudinal axis of the cylinder in much the same way as in the previous embodiment. The actuator bars 101A (102A) in each set are axially aligned and are connected respectively to the movable blades 71A in each pinching row unit 50A so as to pivot the blades in a direction of closing the blades when the actuator bars 101A (102A) are driven by cam rollers 110A to shift axially inwardly as shown in the top part of FIG. 13, and to pivot the blades in a direction of opening the same when the actuator bars 101A (102A) are urged by a return spring 120 to shift axially outwardly as shown in the bottom part of FIG. 13. The return spring 120 are of exactly the same configuration as shown in FIGS. 8 and 9. Formed at the inner end of each actuator bar is a stepped section 108 of reduced thickness which includes a slit 109 for connection with the movable blade, as best shown in FIG. 15. The actuator bars in each set are assembled to the rotary cylinder in such a manner as to overlap the stepped sections 108, thereby enabling to pivoting the blades successfully.

Figure 16:
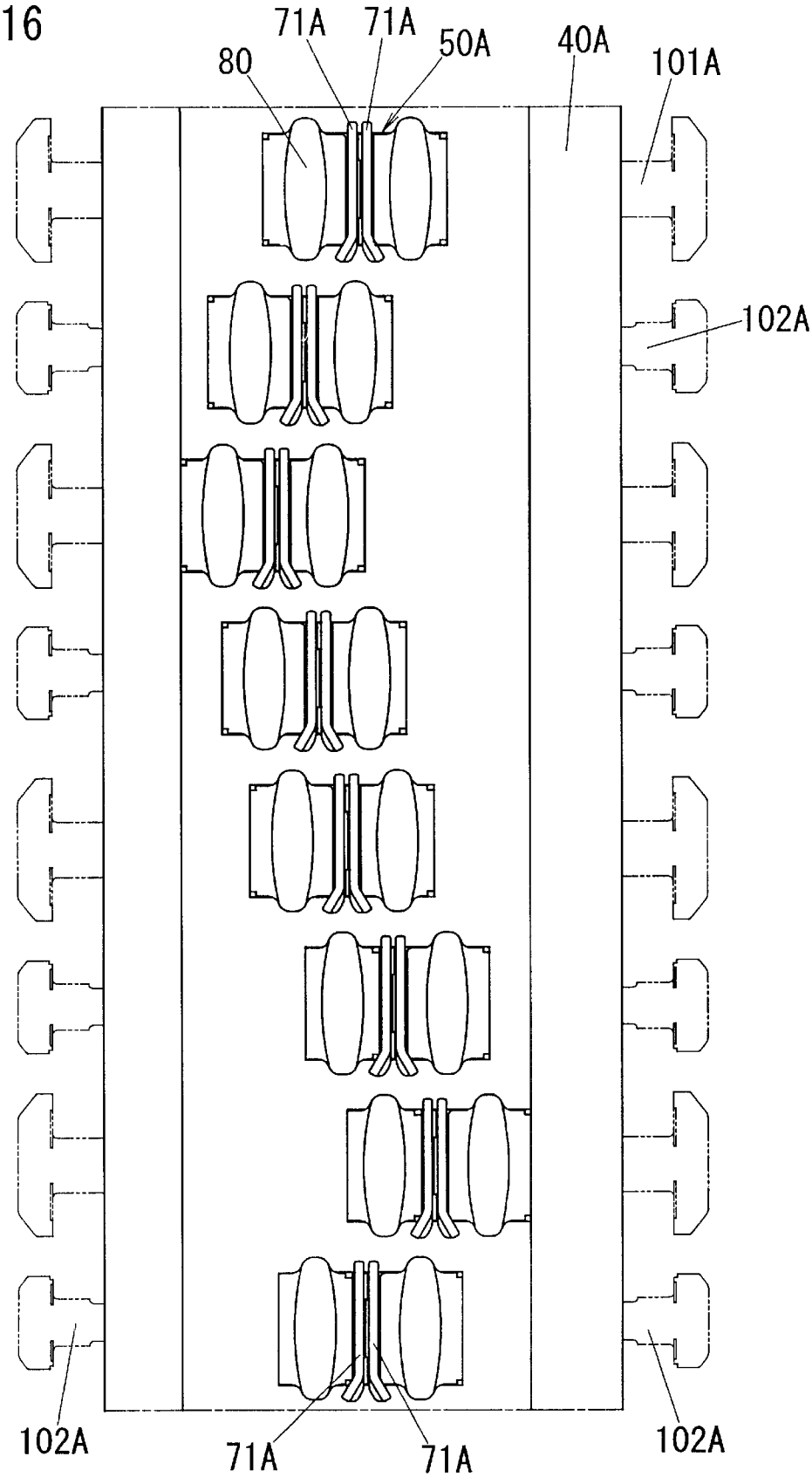
FIG. 16 is an expanded view of the rotary cylinder showing the arrangement of the pinching row units.

As shown in FIG. 16, the pinching row units 50A are spaced evenly around the rotary cylinder 40A and at the same offset from each other with respect to the lengthwise or axial direction of the cylinder so as to cover a wide hair plucking area per one rotation of the cylinder.

Although the above description illustrates typical structures of the pinching row unit, it should be noted that the present invention can equally applied to pinching row of different structures. For example, the pinching row may include at least one blade set in which two movable blades are disposed on opposite of a single stationary blade and are driven by the corresponding actuator bars to pivot against and away from the stationary blade. In any case, a set of circumferentially arranged actuator bars provided for a plurality of the circumferentially arranged pinching row units are commonly coupled to one return spring. Further, the set of blades in each pinching row unit is offset from the set of blades in any other pinching row unit for maximum hair plucking efficiency within a length of the cylinder.

What is claimed is:

1. A hand-held epilating device comprising:

a housing to be grasped by a hand of a user;

a rotary cylinder mounted to said housing and having a longitudinal axis, said rotary cylinder carrying a plurality of pinching row units circumferentially spaced about said longitudinal axis, each of said pinching row units comprising at least one set of blades arranged along said longitudinal axis, a plurality of actuator bars being arranged circumferentially about said longitudinal axis and associated with said pinching row units, respectively, each of said actuator bars extending through said rotary cylinder and being driven to shift along said longitudinal axis to move at least one of the blades in each pinching row unit against and away from an adjacent blade catching and pinching hairs therebetween;

a drive mechanism for driving said actuator bars to reciprocate along said longitudinal axis while rotating the rotary cylinder about the longitudinal axis for pinching the hairs between the adjacent blades and plucking the hairs from the user's skin, wherein all the circumferentially spaced actuator bars are coupled commonly to a single return spring so as to be urged thereby in a direction of disengaging the blade from the adjacent blade.

2. The epilating device as set forth in claim 1, wherein said return spring comprises a plurality of spring arms extending radially from a center hub secured to said rotary cylinder, each of said spring arms being held in pressing engagement simultaneously with the circumferentially adjacent actuator bars for urging said actuator bars axially outwardly of said rotary cylinder.

3. The epilating device as set forth in claim 2, wherein each of said spring arms is U-shaped to have a first radial segment extending from the hub and a second radial segment which extends from an outer radial end of said first radial segment through an arc segment and projects radially inwardly from the arc segment, said second radial segment being held in pressing engagement commonly with the circumferentially adjacent actuator bars.

4. The epilating device as set forth in claim 3, wherein said spring arms extend in a spiral fashion from said center hub about an axis of the hub.

5. The hand-held epilating device as set forth in claim 3, wherein each of said actuator bars has a first end coupled to at least one blade in each set of blades and has a second end projecting on one longitudinal end of said rotary cylinder in an opposing relation to a cam roller which is included in said drive mechanism, said cam roller being positioned to be in selective contact with the second ends of said actuator bars in such a manner as to move the actuator bars in a direction of pinching the hairs between said blades as said rotary cylinder rotates about the longitudinal axis, said second end of each actuator bar being shaped to extend circumferentially about the longitudinal axis of an arcuate flange, said arcuate flanges of the circumferentially adjacent actuator bars being partially overlapped with each other in a radial direction of said rotary cylinder such that the overlapped portions of said arcuate flanges come simultaneously into contact with said cam roller, and said spring arm of said return spring being engaged with the radially overlapped portions of said arcuate flanges of the circumferentially adjacent actuator bars.

6. The epilating device as set forth in claim 5, wherein each of said arcuate flanges is formed at its opposite ends with receding slant faces away from said cam roller.

7. The epilating device as set forth in claim 2, wherein said center hub is formed with a hole which receives a portion of said rotary cylinder in order to fixedly mount said return spring to said rotary cylinder as well as to allow an axle to pass therethrough for supporting said rotary cylinder to the housing.

8. The epilating device as set forth in claim 1, wherein each of said pinching row units comprises a plurality of stationary blades and a corresponding number of movable blades which are arranged alternately with each other in a direction parallel to said longitudinal axis, two longitudinally adjacent stationary blades in each of said pinching row units are integrally shaped from the same metal into a single integrated piece in which said two adjacent stationary blades are inseparably continuous with one another, said integrated piece being associated with two adjacent said movable blades which are connected commonly to one of said actuator bars and are caused by said actuator bar to move simultaneously against and away from said stationary blades of said integrated piece.

9. The epilating device as set forth in claim 8, wherein said two movable blades associated with said integrated piece are pivotally supported to a holder plate so as to be pivotable about a pivot axis perpendicular to the longitudinal axis of said rotary cylinder for movement against and away from the associated stationary blades, said holder plate mounting at least one said integrated piece and said associated movable blades and consolidating these members together into a self-sustained sub-assembly which is fitted on a surface of said rotary cylinder.

10. The epilating device as set forth in claim 9, wherein said holder plate mounts a skin guide which is disposed between the two adjacent stationary blades of the integrated piece and has an arcuate surface for smooth contact with the skin of the user's body, said skin guide also being consolidated into said sub-assembly.

11. The epilating device as set forth in claim 10, wherein said skin guide has a grip which fixes said integrated piece to said holder plate in a correct position relative to the associated movable blades.

12. The epilating device as set forth in claim 10, wherein said arcuate surface of said skin guide is formed at its one end with a rounded edge which is continuous with a remainder of said arcuate surface and has a curvature which is greater than that of the remainder of said arcuate surface.

13. The epilating device as set forth in claim 9, wherein two said integrated pieces are mounted to one said holder plate to constitute said sub-assembly in which four said stationary blades are evenly spaced along the longitudinal axis of rotary cylinder.

14. The epilating device as set forth in claim 13, wherein said rotary cylinder carries a plurality of said sub-assemblies spaced circumferentially about said longitudinal axis with said sub-assemblies being staggered with each other with respect to the longitudinal axis of said rotary cylinder.

15. The epilating device as set forth in claim 14, wherein all of said stationary blades are offset from each other with respect to the longitudinal axis of said rotary cylinder.

16. The epilating device as set forth in claim 8, wherein said two adjacent stationary blades are interconnected by a pair of beams extending in the direction of said longitudinal axis and merging at opposite lengthwise ends into lower ends of said stationary blades, and a resilient segment being formed at the connection between the beams and the stationary blades so as to be responsible for absorbing a stress applied to the stationary blade from the associated movable blade.

17. The epilating device as set forth in claim 1, wherein each of said blades is formed at its one end facing toward a rotating direction of said rotary cylinder with a flared edge, said flared edges of the adjacent blades being cooperative with each other to define therebetween a tapered groove for guiding the hairs into between the blades.

18. The epilating device as set forth in claim 1, wherein said at least one set of blades comprises two movable blades which are respectively connected to two actuator bars arranged along the longitudinal axis of said rotary cylinder so as to be driven thereby to move against and away from each other for catching and pinching the hairs therebetween.

19. The epilating device as set forth in claim 1, wherein said set of blades in each pinching row unit are offset with respect to the longitudinal direction of said rotary cylinder from the set of blades in the circumferentially adjacent pinching row unit.

20. The epilating device as set forth in claim 1, wherein said at least one set of blades comprises a stationary blade and a pair of movable blades on opposite sides of said stationary blade, each of said movable blades being connected to each one of two actuator bars arranged along the longitudinal axis of said rotary cylinder so as to be driven thereby to move against and away from said stationary blade for catching and pinching the hairs therebetween.

21. The epilating device as set forth in claim 1, wherein said at least one set of blades comprises a stationary blade and a movable blade, said movable blade being connected to one of said actuator bars so as to be driven thereby to move against and away from said stationary blade for catching and pinching the hairs therebetween.

* * * * *